US007914427B2

(12) United States Patent
Shinomiya et al.

(10) Patent No.: US 7,914,427 B2
(45) Date of Patent: Mar. 29, 2011

(54) EXERCISE ASSISTING APPARATUS

(75) Inventors: Youichi Shinomiya, Ibaraki (JP); Takahisa Ozawa, Katano (JP); Kazuhiro Ochi, Osaka (JP); Yuritsugu Toyomi, Shimonoseki (JP); Minoru Kawamoto, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/596,764

(22) PCT Filed: Apr. 23, 2008

(86) PCT No.: PCT/JP2008/057860

§ 371 (c)(1),
(2), (4) Date: Oct. 20, 2009

(87) PCT Pub. No.: WO2008/133277

PCT Pub. Date: Nov. 6, 2008

(65) Prior Publication Data

US 2010/0093505 A1 Apr. 15, 2010

(30) Foreign Application Priority Data

Apr. 23, 2007 (JP) ..... 2007-113458

(51) Int. Cl.
*A63B 26/00* (2006.01)

(52) U.S. Cl. ..... 482/142; 482/139; 482/148

(58) Field of Classification Search ..... 482/51, 482/91–92, 142, 148, 63, 66, 57, 139
See application file for complete search history.

(56) References Cited

U.S. PATENT DOCUMENTS

| | | | | |
|---|---|---|---|---|
| 6,926,645 | B1 * | 8/2005 | Stearns et al. | 482/62 |
| 2006/0229171 | A1 * | 10/2006 | Severino | 482/93 |
| 2008/0312040 | A1 * | 12/2008 | Ochi et al. | 482/8 |
| 2010/0093495 | A1 * | 4/2010 | Ozawa et al. | 482/8 |

FOREIGN PATENT DOCUMENTS

| | | | |
|---|---|---|---|
| EP | 0 878 216 | A1 | 11/1998 |
| JP | 2005-58733 | A | 3/2005 |
| JP | 2007-89650 | A | 4/2007 |
| JP | 2007-89652 | A | 4/2007 |
| WO | WO-97125107 | A1 | 7/1997 |

OTHER PUBLICATIONS

International Search Report for the Application No. PCT/JP2008/057860 mailed Jul. 29, 2008.

* cited by examiner

*Primary Examiner* — Lori Baker
(74) *Attorney, Agent, or Firm* — Cheng Law Group, PLLC

(57) ABSTRACT

An exercise assisting apparatus has a seat with a contact surface of which position is varied within an adjustable range defined by a user's physique in order to successfully adjust the user's knee at a desired bent angle irrespective of the user's height. The seat 21 bears the buttock of the user M with the user's feet resting on a foot supporting surface on top of a foot stand 40. The seat 21 is displaced by a seat driver 50 with a motor in a direction of varying the user's weight acting on the legs of the user M. The seat 21 is driven by an elevator mechanism 60 to move up and down together with the seat driver 50. The elevator mechanism 60 moves the seat 21 in a direction which is restricted to a line inclined rearwardly and upwardly with respect to a vertical direction and deducted by a user of maximum physique and a user of minimum physique.

4 Claims, 6 Drawing Sheets

EXERCISE ASSISTING APPARATUS

TECHNICAL FIELD

The present invention relates to a exercise assisting apparatus of a passive type wherein the weight of a user acting on the legs of the user is varied by using a drive source to displace a seat with the user's feet resting on a foot supporting surface and the user's buttocks supported by the seat.

BACKGROUND ART

Japanese Patent Application Publication No. 2005-58733 (Patent Document 1) and Japanese Patent Application Publication No. 2007-89650 (Patent Document 2) propose an exercise assisting apparatus wherein a thigh muscle group is tensed and relaxed with hardly any extension of the knee, by displacing a seat with the user's feet resting on a foot supporting surface and the user's buttocks supported on a contact surface of the seat. This exercise assisting apparatus varies the user's weight acting on the user's legs by changing the ratio of the user's weight supported by a seat by displacing the position of the seat.

By an operation of this kind, the load is reduced compared to a case where the whole weight acts on the user's legs, and the thigh muscles are contracted with hardly any extension of the knee, whereby, for example, even a user having knee pain such as a patient with diabetes is able to strengthen the muscle group of the thigh, and furthermore since the muscle group of the thigh has a large volume, it is also expected to obtain a contribution to improvement in lifestyle-related diseases, by glucose metabolism associated with the muscular contraction. Moreover, by using a drive source to displace the seat, the user is able to exercise passively without exerting muscular force spontaneously, and therefore the load is light and consequently the apparatus can be used even by person's having a low capacity of movement.

Incidentally, an exercise assisting apparatus having the composition described above tenses and relaxes the thigh muscle group by changing the weight of the user that acts on the user's legs, with virtually no extension of the knees, and therefore the knee bending angle is an important factor in performing exercise effectively. As the analogy of a squatting movement readily shows, the load acting on the muscle group of the thigh varies with the knee bending angle. Furthermore, in the case of a user with knee pain, if a load acts on the user's knee while the knee is bent to a certain degree, the user often experiences pain and the bending angle must be restricted in order to make an apparatus usable by persons of this type as well.

At the present time, experimental results have been obtained indicating that the exercising effect is high and knee pain is not liable to occur, if the knee bending angle (in practice, the measured angle is that formed between the thigh and the lower leg on the front side of the knee) is set to 140 degrees, and hence this angle has been set as an appropriate angle.

In the apparatus described in Patent Document 2, it is proposed that the position of the seat is made adjustable in such a manner that the knee bending angle becomes the appropriate angle, and the position of the seat is adjusted automatically in accordance with an input parameter relating to the user's height. The position of the seat is adjustable in at least one of the vertical direction and the forward/rearward direction, and the horizontal distance from the foot position becomes greater if the seat is raised, while the horizontal distance from the foot position becomes smaller if the seat is lowered.

Patent Document 2 describes making the knee bending angle adjustable to an appropriate angle by adjusting the position of the seat, and suggests relating the position of the seat at which the knee bending angle becomes an appropriate angle to a parameter corresponding to the user's height, but does not provide a theory about how to change the seat position with respect to the user's height in order to achieve a desired knee bending angle. Consequently, in the composition described in Patent Document 2, it is not clear how the user's height and the position at which the user's buttocks are supported by the seat are related in order to set the knee bending angle to a desired angle.

DISCLOSURE OF THE INVENTION

The present invention is devised in view of the above reasons. An object in this invention is to provide an exercise assisting apparatus which is configured to adjust the knee bending angle to a desired angle regardless of the user's height. The adjustment is performed by specifying the range of adjustment of the position of a contact surface of the seat on the basis of the theory of the relationship of the position of the contact surface which supports a user's buttocks in a seat, the knee bending angle, and the user's height.

The exercise assisting apparatus relating to the present invention comprises: a seat having a contact surface configured to support thereon a buttock of a user with the user's feet resting on a predetermined foot supporting surface; a seat driving mechanism configured to use a driving source for displacing the seat in a direction of varying the user's weight acting on the user's legs; and an elevator mechanism configured to adjust a vertical position and a forward/rearward position of the contact surface of the seat in order to keep a user's knee bending angle at a prescribed angle while the user is sitting on the seat held at a reference position with the user's feet placed on a predetermined position on the foot supporting surface. The elevator mechanism is configured to adjust the position of the contact surface of the seat member within a restricted range along a line which is inclined rearwardly and upwardly with respect to a vertical direction and is deduced by a user of maximum physique and a user of minimum physique. Therefore, it is possible to restrict theoretically the range of adjustment of the position of the contact surface of the seat, and as a result of this, adjustment which keeps the knee bending angle at a desired angle can be performed reliably, irrespectively of the height of the user.

Desirably, the elevator mechanism is composed so as to comprise an elevator driver for displacing the position of the seat with respect to a base held at a fixed position. The elevator driver is configured to vary the position of the seat linearly along a path inclined rearwardly and upwardly at a predetermined angle within a vertical plane in which the seat is allowed to move vertically and forward/rearward. Since the elevator mechanism varies the position of the seat linearly in this way, then the elevator mechanism can be achieved by means of a simple mechanism which moves the seat linearly.

Desirably, the elevator driver comprises a fixed member secured to the base, a movable member configured to move along a linear path relative to the fixed member and support the seat, and a drive motor configured to move the movable member towards and away from the fixed member. In this case, the driving force of the drive motor can be used to raise and lower the seat, and the position of the seat can be adjusted even when the user's buttocks are supported on the seat.

BEST MODE FOR CARRYING OUT THE INVENTION

Figure 1:
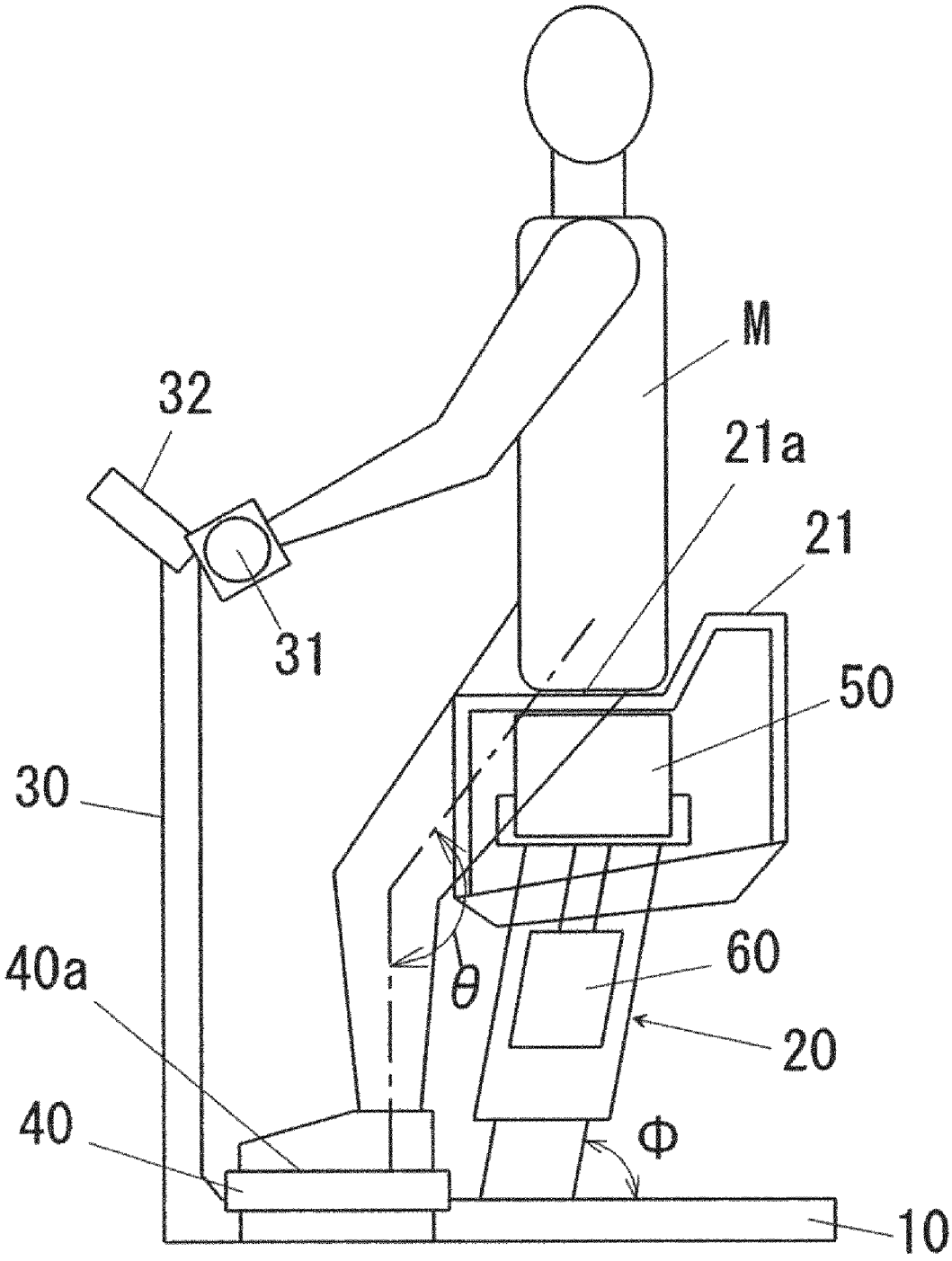
FIG. 1 is a schematic side view showing an exercise assisting apparatus relating to one embodiment of the present invention.
Figure 2:
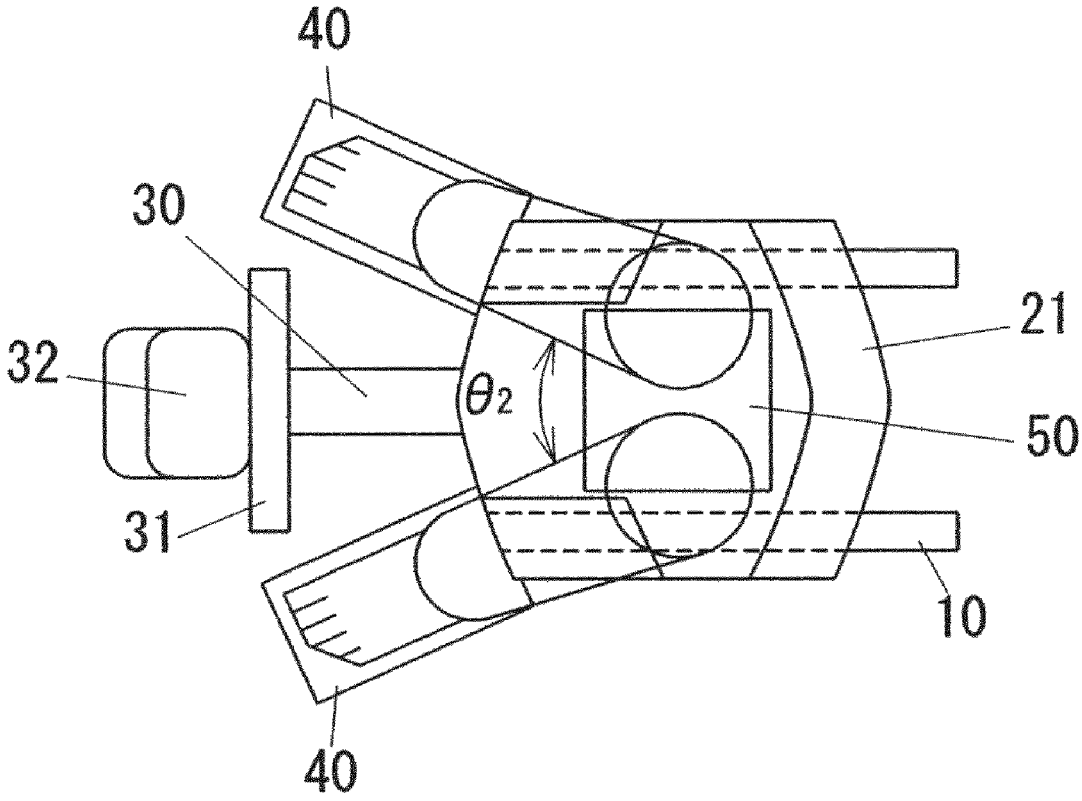
FIG. 2 is a schematic plan view of the exercise assisting apparatus.

As shown in FIG. 1 and FIG. 2, the exercise assisting apparatus relating to one embodiment of the present invention has a base 10 which is disposed in a fixed position on a floor, or the like, and provided on top of this base 10 are: a seat support base 20 having a seat 21 which supports the buttocks of a user M provided on the upper end thereof, and a handle post 30 having a handle 31 which the user M grips with his or her hands as necessary provided on the upper end thereof. A foot stand 40 is arranged on the base 10 so as to be located between the seat support base 20 and the handle 30. The foot stand 40 has the upper surface of which forms a foot supporting surface 40*a*. The foot stand 40 restricts the position of the user's feet by means of the user M placing his or her feet on the foot supporting surface 40*a*.

Provided on the seat support base 20 are: a seat driver 50 which causes the seat 21 to oscillate, and an elevator mechanism 60 which raises and lowers the seat 31 and the seat driver 50 with respect to the base 10. The composition of the seat driver 50 and the elevator mechanism 60 is described below.

The seat driver 50 operates the drive source to swing the seat 21, thereby the seat driver 50 changing the weight of the user M who sits on the contact surface 21*a* of the seat 21 and who places the feet on the supporting surface 40*a* of the foot stand 40. As a result, the weight of the user M that acts on the user's knee is changed. In other words, the body weight of the user M is supported by the buttocks and the legs in a distributed fashion. In this context, when the position of the user's buttock is varied, the weight supported by the buttocks is increased and decreased. According to variation of the weight supported by the buttock, the weight acting on the legs is changed.

When the knees are bent by a prescribed angle, then if the ratio of the body weight supported by the seat 21 is decreased, the load acting on the thighs of the user M is increased and the muscle group of the thigh region can be made to contract, similarly to bending the knees by performing a squat movement. In other words, when the seat 21 is caused to oscillate by the drive source, the thigh muscle groups repeat a tensing and relaxing action by means of a passive movement which is not a spontaneous movement of the user M. In other words, it is possible principally to exercise the thigh region by means of the seat driver 50 causing the seat 21 to oscillate.

The direction of oscillation of the seat 21 is desirably set in such a manner that no shearing force acts on the knee joints. When the buttocks of the user M are supported by the contact surface 21*a* of the seat 21, the user M's feet naturally adopt an attitude where the distance between the toe tips is greater than the distance between the heels, as shown in FIG. 2, and the angle of opening θ2 between the feet can be determined from the position where the feet are placed on the foot stand 40. Therefore, it is possible to exercise without applying a shearing force to the knee joints by oscillating the seat 21 in a direction following the central lines that link the heels and the tips of each foot when the user's feet are placed on the foot stand 40. In other wards, it is preferred to provide a time period during which the seat 21 moves obliquely rightwards and forwards and a time period during which the seat 21 moves obliquely leftwards and forwards when the seat 21 moves forward from the rear end position in the range of oscillation. Consequently, it is possible to make the user's weight act respectively on the thigh area of the left legs and the right legs, without applying a shearing force to the knee joints.

In the example shown in FIG. 1, the contact surface 21*a* which is the upper surface of the seat 21 is a substantially horizontal surface. However, the exercise which stimulates muscular contraction of the thigh muscle group is performed by changing the weight of the user M that is acting on the user's legs. Therefore, it is desirable that the contact surface 21*a* of the seat 21 making contact with the buttocks of the user M should be inclined downwardly in the forward direction of the direction of oscillation of the seat 21. In other words, desirably, the portion which supports the right buttock area of the user M in the front end portion of the seat 21 in inclined obliquely downwards in the rightward and forward direction. Similarly, desirably, the portion which supports the left buttock area of the user M is inclined obliquely downwards in the leftward and forward direction. If a shape of this kind is adopted, then when the seat 21 is moved forward from the rear end position of the oscillation range, the user's weight acting on the legs is liable to increase and the exercising effect can be raised.

A control and display apparatus 32 is provided in the central part of the handle 31 on the upper end portion of the handle post 30. The control and display apparatus 32 is provided for operation of issuing instructions in respet of the operation of the seat driver 50 and the elevator mechanism 60, and for display of measures indicating the amount exercise, and the like. The user M is able to stabilize the position of his or her upper body by gripping the handle 31.

Figure 4:
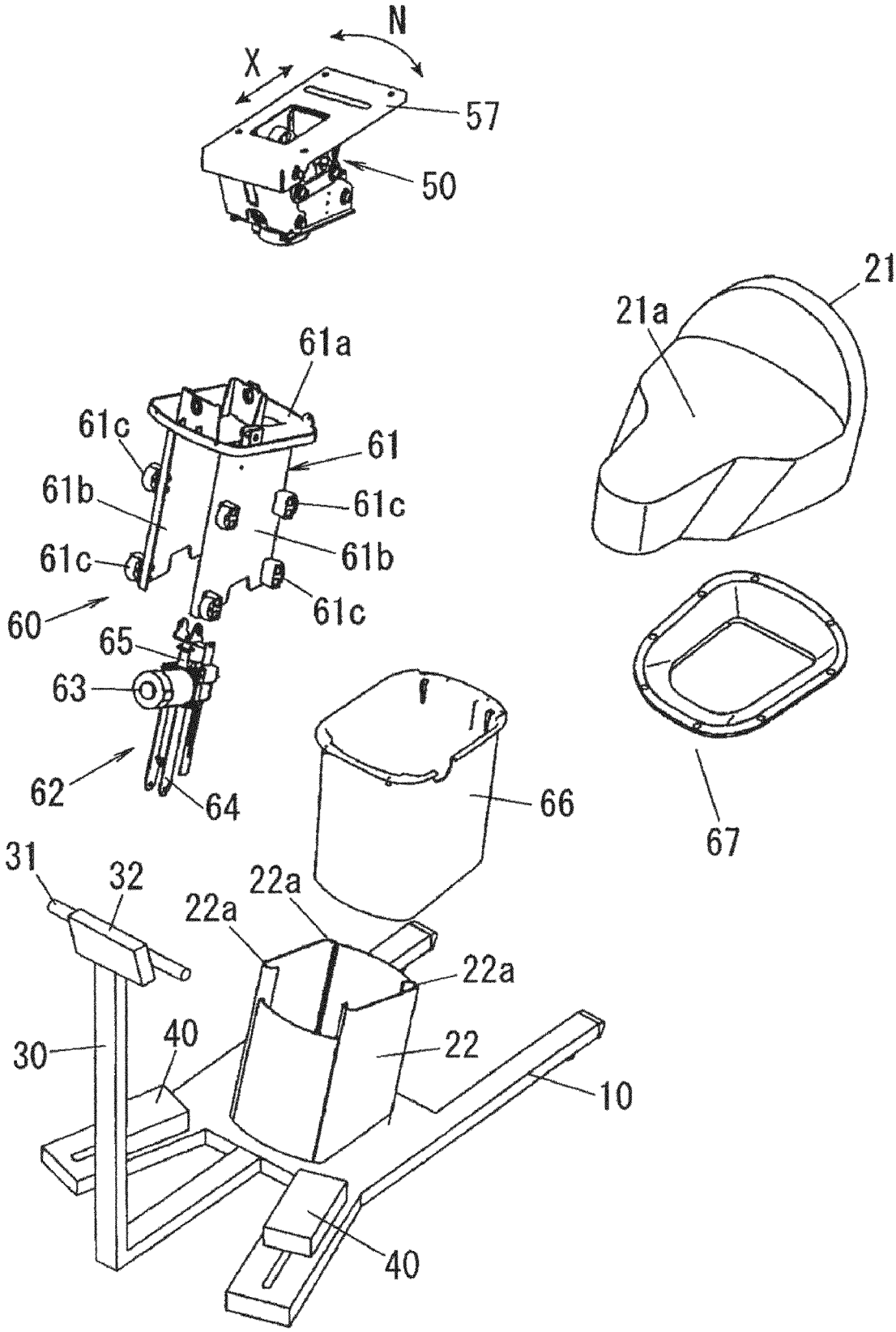
FIG. 4 is an exploded perspective diagram of the exercise assisting apparatus.

The structure of the handle support base 20 is described in more detail below. As shown in FIG. 4, the handle support base 20 has a hollow supporting column 22 which is erected on the base 10, and the lower end portion of the elevator mechanism 60 is accommodated inside the supporting column 22. The elevator mechanism 60 has an elevator base 61 which ascends and descends slidably with respect to the supporting column 22, and the seat driver 50 is mounted on the upper end of the elevator base 61. Consequently, the seat driver 50 is able to move with respect to the base 10, together with the seat 21.

The center line of the supporting column 22 is a straight line which is inclined rearwardly with respect to the vertical direction (in other words, inclined rearwardly and upwardly), and by means of the elevator base 61 sliding inside the supporting column 22, the position of the contact surface 21*a* of the seat 21 can be adjusted in a single straight line following the center line of the supporting column 22, in the vertical direction. In other words, the position of the contact surface 21*a* of the seat 21 is adjusted in the forward/rearward direction simultaneously with being adjusted in the vertical direction. In addition, the further the position of the contact surface in the upward direction, the further its position in the rearward direction. The angle formed between the center line of the supporting column 22 and the base 10 is described hereinafter.

The elevator base 61 is driven to ascend and descend by an elevator driver 62 which comprises a drive motor 63. The elevator driver 62 comprises, in addition to the drive motor 63, a column-shaped fixed member 64 which is fixed to the base 10, and a movable member 65 which comprises a ball screw that screws into the fixed member 64, and employs a composition whereby the movable member 65 is advanced and retracted with respect to the fixed member 64 by decelerating the rotation of the drive motor 63 so as to rotate the movable member 65. The elevator base 61 is installed on the upper end portion of the movable member 65, and ascends and descends with the advancing or retreating movement of the movable member 65 with respect to the fixed member 64.

The elevator base 61 comprises a seating 61*a* and a pair of guide plates 61*b*. The seat driver 50 is mounted on the seating 61*a*. A pair of the guide plates are provided on the lower surface of the seating 61*a*. The upper end portion of the movable member 65 in the elevator driver 62 is coupled to the lower surface side of the seating 61*a*. Furthermore, rollers 61*c* are installed on the outer surfaces of the guide plates 61*b*, and by guiding these rollers 61*c* in rail sections 22*a* provided on the inner surface of the supporting column 22, it is possible to move the elevator base 61 smoothly with respect to the supporting column 22. A sensor which determines the amount of advance or retreat of the movable member 65 with respect to the fixed member 64 is provided, and the rotation of the drive motor 63 is controlled in such a manner that the value determined by the sensor coincides with a target value specified in accordance with an input via the display and control unit 32. However, since this composition is not an essential feature, further description thereof is not included here.

A tubular elevator cover 66 is attached to the seating 61*a* of the elevator base 61. The lower end portion of the elevator cover 66 overlaps with the outer surface of the supporting column 22 in the range of extension and contraction of the elevator driver 62, and by this means the elevator base 61 is not exposed to the exterior even when the elevator driver 62 is extended by the maximum amount. Moreover, a mechanical unit cover 67 formed from a cloth-like soft material is attached to the seating 61*a* of the elevator base 61. The mechanical unit cover 67 prevents the seat driver 50 from being exposed to the exterior by covering the portion between the seating 61*a* and the seat 21.

Figure 5:
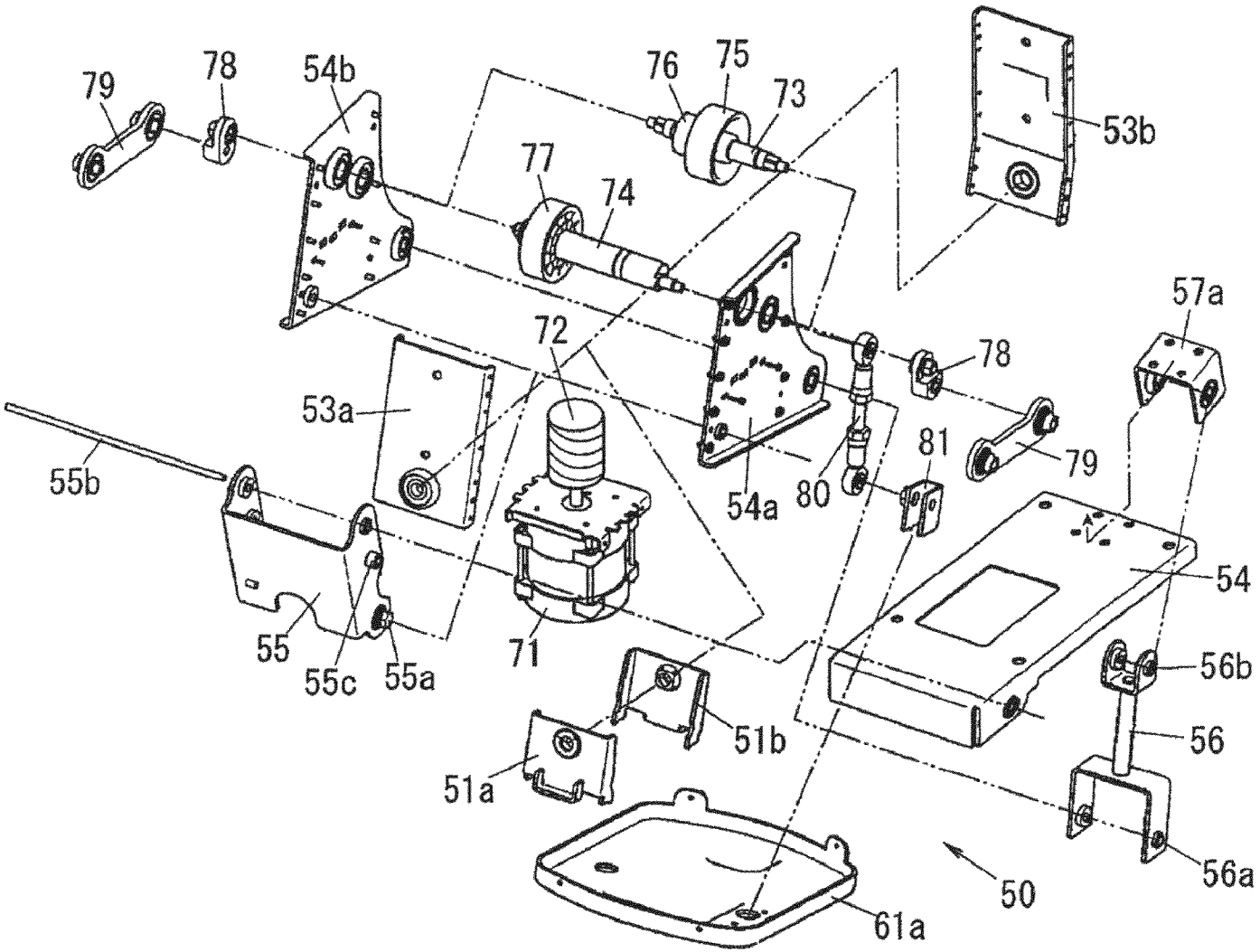
FIG. 5 is an exploded perspective diagram of a seat driver used in the exercise assisting apparatus.
Figure 6:
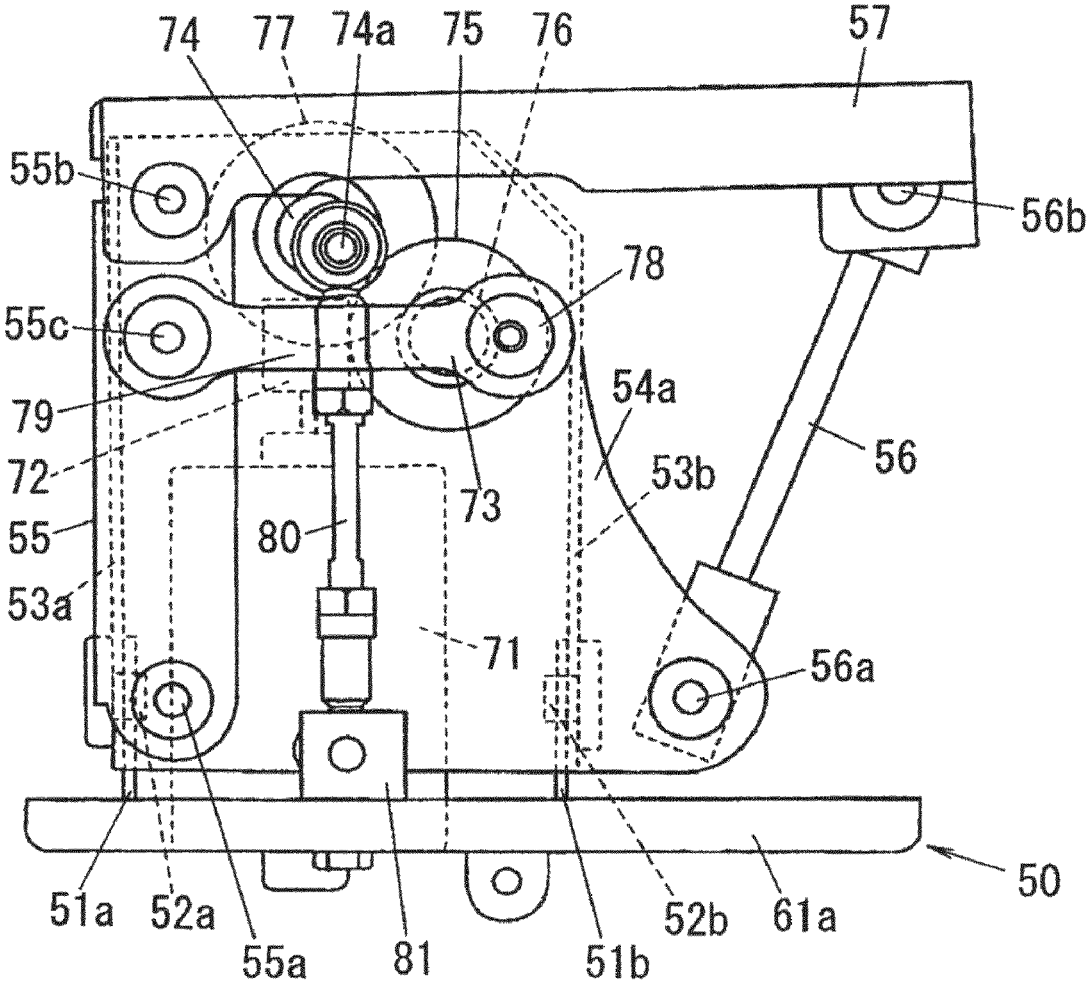
FIG. 6 is a side view diagram of a seat driver used in the exercise assisting apparatus.

Next, the seat driver 50 is described with reference to FIG. 5 and FIG. 6. The seat driver 50 constitutes a mechanism which causes the seat 21 to oscillate together with the seating 61*a* of the elevator base 61. The seat driver 50 is installed axially on a front and rear pair of axle plates 51*a*, 51*b*, and axles 52*a*, 52*b*. The front and the rear pair of axle plates 51*a*, 51*b* are provided in an upright fashion on the upper surface of the seating 61*a*. The front and rear axles 52*a*, 52*b* are disposed coaxially, and by means of the seat driver 50 rotating about these axles 52*a*, 52*b*, the seat 21 which is coupled to the seat driver 50 can be caused to oscillate leftwards and rightwards (in the directions indicated by arrow N in FIG. 4).

The seat driver 50 comprises a front and rear pair of frame plates 53*a*, 53*b*, and these two frame plates 53*a*, 53*b* are coupled via a left and right-hand pair of frame side plates 54*a*, 54*b*. The lower end portions of a front link 55 and a rear link 56 which rotate about an axis in the left/right direction are installed axially by means of axles 55*a*, 56*a* on the two frame side plates 54*a*, 54*b*, and the upper end portions of the front link 55 and the rear link 56 are installed axially on a base plate 57 by means of axles 55*b* and 56*b*. Here, the upper end portion of the rear link 56 is installed axially on a bearing plate 57*a* which is fixed to a base plate 57 rather than being axially installed directly on the base plate 57.

The range of movement of the base plate 57 is restricted in such a manner that the front end portion of the base plate 57 moves through a circular arc centered on the axle 55*a*, and the rear end portion of the base plate 57 moves through a circular arc centered on the axle 56*a*. Here, the rear link 56 is formed to a longer dimension than the front link 55, and hence the front end portion and the rear end portion of the base plate 57 have different radii of curvature, whereby the angle of inclination of the upper surface changes as the base plate 57 moves forwards and rearwards. More specifically, if the position shown in FIG. 6 is taken as the rear end position of the range of movement in the forward/rearward direction, then as the base plate moves forward, the front end portion of the base plate 57 descends relatively with respect to the rear end portion thereof, thereby increasing the angle of inclination of the upper surface. Conversely, if the base plate is moved rearwards from the front end position, the front end portion of the base plate 57 rises upwards relatively with respect to the rear end portion, thereby reducing the angle of inclination of the upper surface. In other words, the seat 21 can be moved in the forward/rearward direction (the direction indicated by arrow X in FIG. 4). FIG. 4 depicts linear movement, but in actual practice, because the angle of inclination of the forward/rearward direction changes, then the displacement combines a linear movement and a rotational movement in the forward/rearward direction.

The motor 71 which is a drive source for oscillating the base plate 57 with respect to the base plate 61*a* is held by both frame side plates 54*a* and 54*b*. Furthermore, the motor 71 is disposed vertically in such a manner that the output shaft thereof projects in the upward direction. A worm gear 72 is coupled to the output shaft of the motor 71. A first shaft 73 and a second shaft 74 are supported on the frame side plates 54*a* and 54*b*, and a worm wheel 75 which meshes with the worm gear 72 is provided on the first shaft 73. A gear 76 is also provided on the first shaft 73 and the gear 76 meshes with a gear 77 which is provided on the second shaft 74.

Eccentric cranks 78 which rotate together with the first shaft 73 are attached respectively to either end of the first shaft 73. One end of an arm link 79 is axially installed respectively on each eccentric crank 78, and the other ends of the arm links 79 are axially installed respectively on axle pins 55*c* which project to the left and right of the front link 55.

By means of this composition, when the motor 71 turns and the first shaft 73 rotates, the front link 55 moves back and forth reciprocally in the forward/rearward direction about the axles 55*a* due to the eccentric cranks 78 and the arm links 79, and the front portion of the base plate 57 oscillates in the forward/rearward direction about the axles 55*a* (the direction indicated by arrow X in FIG. 4). Furthermore, after the rear link 56 has turned about the axles 56*a*, the angle of inclination of the upper surface changes with the movement of the base plate 57 in the forward/rearward direction.

On the other hand, an eccentric pin 74*a* is provided in a standing fashion on one end portion of the second shaft 74, and one end portion of an eccentric rod 80 is installed axially on this eccentric pin 74*a*. The other end portion of the eccentric rod 80 is coupled in an oscillatable fashion to a coupling piece 81 which is attached to the seating 61*a*. The pin 74*a* and the eccentric rod 80 may be provided on either the left or right-hand side of the seat driver 50.

By means of this composition, if the motor 71 is turned and the second shaft 74 is rotated via the first shaft 73, then the height position of the eccentric pin 74*a* with respect to the seating 61*a* changes with the pin 74*a* and the eccentric rod 80, and as a result, the base plate 57 oscillates leftwards and rightwards about the axles 52*a* and 52*b* (the direction indicated by arrow N in FIG. 4).

A brushless DC motor, or the like, is used for the motor 71, and a DC motor is also used for the drive motor 63. Here, since the motor 63 is disposed in a space which is surrounded by the frame plates 53*a*, 53*b*, the frame side plates 54*a*, 54*b*, the seating 61*a* and the base plate 57, and since the gears 75 to 77 are also disposed in the same space, then the seat driver 50 is compact.

Basically, the seat driver 50 moves the seat 21 in a rightward forward and downward direction and a leftward forward and downward direction. However, in the composition described above, by appropriately setting the gear ratios of the gears 76 and 77, and the phase differential between the eccentric crank 78 and the eccentric pin 74*a*, then apart from a V-shaped path of movement of the seat 21 (where two reciprocal forward and rearward movements are performed during one reciprocal movement in the left/right direction), the path of movement of the seat 21 can also be set to a W shape (where four reciprocal forward and rearward movements are performed during one reciprocal movement in the left/right direction), or a figure of eight shape (where two reciprocal forward and rearward movements are performed during one reciprocal movement in the left/right direction and the rear end positions are skewed to the left and right-hand sides), and so on.

The operation and halting of the drive motor 63 and the motor 71 are commanded by operating the control and display apparatus 32. In other words, a control section for instructing the operation or halting of the motor 71 and the speed of revolution of the motor 71 is provided in the control and display apparatus 32, and hence the exercise time period and the exercise intensity can be specified. Furthermore, a control section for raising or lowering the seat 21 is provided in such a manner that the knee bending angle assumes an appropriate angle. The control section and the display section provided in the control and display apparatus 32 are connected to the operation of the motor 71 and the drive motor 63 by means of a control circuit (not illustrated).

In the exercise assisting apparatus described above, it is necessary to keep the knee bending angle at an appropriate angle in order to promote contraction of the thigh muscle group without causing knee pain, even in the case of a user M who suffers from knee pain. That is, the exercise assisting apparatus gives the movement of changing the user's weight acting on the thigh to the user having the knee angle at a prescribed angle. When the user uses the exercise assisting apparatus, the user's feet are fixed in position by resting on the foot stand 40. Here, it is desired that the knee joint is aligned along the vertical direction to the foot joint in order to increase the load acting on the thigh. Therefore, due to these restricting conditions, the knee bending angle is governed by the position of the seat 21. Leg dimensions vary between different individuals, and change significantly with the height of the user M.

As described above, the height position of the seat 21 is adjustable by means of the elevator mechanism 60, and furthermore, by moving the seat 21 in a straight line which is inclined rearwards with respect to the base 10, the elevator mechanism 60 adjusts the position of the contact surface 21*a* of the seat 21 in such a manner that the further the contact surface moves upwards, the further the contact surface is positioned rearwards.

Figure 3:
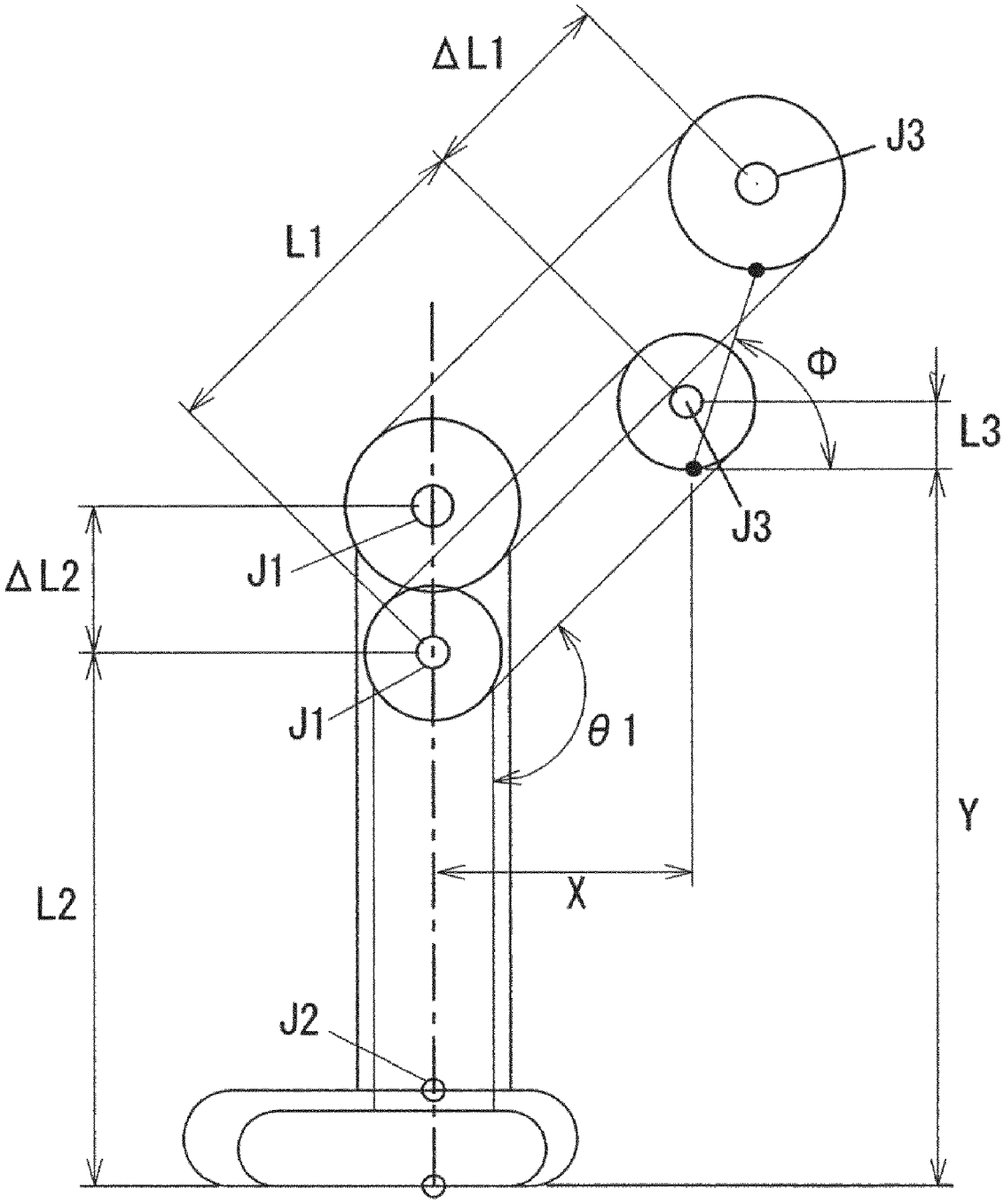
FIG. 3 is a diagram describing the operational principles of the exercise assisting apparatus.

The direction in which the elevator mechanism 60 moves the seat 21 is described with reference to FIG. 3. It is supposed that with the user's feet resting on the foot stand 40, the straight line linking the foot joint J2 and the knee joint J1 (in other words, the shinbone) coincides with the vertical direction. Furthermore, it is supposed that the angle of opening θ2 between the two feet (see FIG. 2) when the feet are resting on the foot stand 40 is 20 degrees. Moreover, the knee bending angle is θ1 (see FIG. 1), the distance between the hip joint J3 and the knee joint J1 is L1, the distance from the upper surface of the foot stand 40 to the knee joint J1 is L2, and the angle formed between the direction of movement of the seat 21 and the horizontal plane (in other words, the angle formed between the central line of the support column 22 and the base 10) is ϕ.

If these parameters are used, then at the position P1 where the buttocks make contact with the contact surface 21*a* of the seat 21 (the intersection of the plumb line from the center of gravity of the user's trunk with the contact surface 21*a*), the horizontal distance X between position P1 and the foot joint J2 and the height Y of position P1 from the upper surface of the foot stand 40 can be represented by the following expressions.

$$X=L1\cdot\sin(180°-\theta1)\cdot\cos(\theta2/2)$$

$$Y=L1\cdot\cos(180°-\theta1)+L2-L3$$

L3 is the distance between the position P1 and the hip joint J3. For example, if the height of the user M is in the range of 140 to 170 cm, then by adopting standard values for the distances L1 and L2, it is possible to derive the angle ϕ by calculation. In other words, taking the differences in the distances L1 and L2 due to difference in physique as ΔL1 and ΔL2 respectively, it is possible to determine the angle ϕ if the maximum value and minimum value of the difference in physique are employed.

When calculation was made using the value for a female aged 65 to 79 (standard value) as the minimum physique value, and using the value for a male aged 65 to 79 (standard value) as the maximum physique value, then it was possible to identify 75 degrees as the angle ϕ whereby the knee bending angle could be kept to 140 degrees in both persons. In other words, when the straight line passing through the positions P1 determined in respect of the maximum and minimum physiques of the user M was found, it was seen that this line was inclined rearwards with respect to the vertical direction and formed an angle of 75 degrees with respect to the horizontal surface.

Here, since the angle ϕ is determined from the positions P1 which are specified for the two points relating to a minimum physique and a maximum physique, then although compatibility with a user M of another physique is not necessarily guaranteed, the aforementioned distances L1 and L2 are predicted to change in a substantially linear fashion with respect to the user's height and therefore linear interpolation between the maximum value and the minimum value is possible. Furthermore, since linear interpolation is possible, then as described above, it is possible to employ a simple mechanism which performs linear movement as the elevator mechanism 60. Here, it is also possible to determine three or more points in respect of differences in physique, and to trace the path of movement of the seat 21 by the elevator mechanism 60 as a curve.

The invention claimed is:

1. An exercise assisting apparatus comprising:

a seat having a contact surface configured to support thereon a buttock of a user with the user's feet resting on a predetermined foot supporting surface;

a seat driving mechanism configured to use a driving source for displacing said seat in a direction of varying the user's weight acting on the user's legs; and an elevator mechanism connected with the seat and configured to adjust a vertical position and a forward/rearward position of said;

wherein said elevator mechanism is configured to adjust the position of the seat a restricted range, said range being on a line or curve between a first seat position and a second seat position, said line or curve being inclined rearwardly and upwardly with respect to a vertical direction, wherein said first seat position is defined as the position of the seat where the contact surface of the seat contacts with a buttock of a first user when:

(A) the straight line linking the foot joint and the knee joint of the first user coincides with the vertical direction;

(B) the first user's feet place on the predetermined position on said foot supporting surface; and (C) the first user's knee bending angle is set to a first angle, said first user being a user of minimum physique, wherein said second seat position is defined as the position of the seat where the contact surface of the seat contacts with a buttock of a second user when:

(a) the straight line linking the foot joint and the knee joint of the second user coincides with the vertical direction;

(b) the second user's feet place on the predetermined position on said foot supporting surface; and (c) the second user's knee bending angle is set to a second angle, said second user being a user of maximum physique, wherein each of said first angle and said second angle is an appropriate angle by which the exercising effect is high and knee pain is not liable to occur.

2. An exercise assisting apparatus as set forth in claim 1, wherein said elevator mechanism comprises an elevation driver for displacing the position of said seat relative to a base held at a fixed position, said elevation driver being configured to vary the position of said seat linearly along a path inclined rearwardly and upwardly at a predetermined angle within a vertical plane in which said seat is allowed to move vertically and forward/rearward.

3. An exercise assisting apparatus as set forth in claim 2, wherein said elevator driver comprises a fixed member secured to said base, a movable member configured to move along a linear path relative to said fixed member and support said seat, and a drive motor configured to move said movable member towards and away from said fixed member.

4. An exercise assisting apparatus as set forth in claim 1, wherein said appropriate angle is set to 140 degrees.

* * * * *